United States Patent [19]

Sears et al.

[11] Patent Number: 4,525,956

[45] Date of Patent: Jul. 2, 1985

[54] IN-SITU ANNULAR FACE GRINDER

[75] Inventors: Billy D. Sears, Waipahu, Hi.; Gerald G. Holland, Fairbanks, Ak.; John R. Cazinha; Donovan J. Reames, both of Kaneohe, Hi.

[73] Assignee: The United States of America as represented by the Secretary of the Navy, Washington, D.C.

[21] Appl. No.: 597,966

[22] Filed: Apr. 9, 1984

[51] Int. Cl.[3] ..... B24B 19/26

[52] U.S. Cl. ..... 51/241 S; 51/241 B

[58] Field of Search ..... 51/241 R, 241 S, 241 B, 51/241 A, 245, 120, 5 D

[56] References Cited

U.S. PATENT DOCUMENTS

| | | | |
|---|---|---|---|
| 2,297,074 | 9/1942 | Rohrdanz | 51/241 B |
| 2,364,506 | 12/1944 | Berezny | 51/241 R |
| 2,528,043 | 10/1950 | Dolmage | 51/245 |
| 2,587,398 | 2/1952 | Smith | 51/245 |
| 2,736,995 | 3/1956 | Richey | 51/241 B |
| 3,758,994 | 9/1973 | Dillinger | 51/241 S |
| 4,069,624 | 1/1978 | Henry, Jr. | 51/241 B |
| 4,361,061 | 11/1982 | Pullen | 82/4 R |
| 4,404,774 | 9/1983 | Sadao | 51/5 D |

*Primary Examiner*—Roscoe V. Parker

*Attorney, Agent, or Firm*—Robert F. Beers; Ervin F. Johnston; Thomas G. Keough

[57] ABSTRACT

A machine is provided for grinding the top surface of an annular body. The machine includes a block which is receivable within the annulus of the body. The top of the block has a central hole. A plurality of rods slidably extend transversely through the block with a first end of each rod extendable into the hole and a second end of each rod extendable from a side of the block opposite the inside curved surface of the annular body. A plurality of arcuate pads are provided wherein each pad has an arc which conforms to the curve of the inside of the annular body. Each pad is connected to a respective second end of each rod. A bolt is threaded into the central hole of the block, the bolt having a bottom tapered portion for engaging the first ends of the rods so that when the bolt is threaded into the block the rods will be forced outwardly to engage the arcuate pads with the inside curved surface of the annular body. A turntable is slidably mounted on the top of the block. A grinding device is mounted on the turntable and has a downwardly facing grinding surface for engaging the top surface of the annular body. A device is provided for moving the grinding surface toward and away from the top surface of the body.

9 Claims, 5 Drawing Figures

IN-SITU ANNULAR FACE GRINDER

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION

U.S. Navy shipyards are continuously involved in periodic overhaul of Navy ships. A major overhaul function is to refurbish valve seats which requires many grinding operations. One such valve seat is the 5" valve seat in a submarine hull. The previous method of refurbishing such a valve seat was to use a lapping plate. After charging the lapping plate with a lapping compound the plate is manually operated in figure eight manipulations on the valve face. After a series of hand manipulations the lapping compound is cleaned away and the lapping plate is recharged with new lapping compound for another series of hand manipulations until a smooth surface is obtained across the entire valve face. This operation is very cumbersome and time consuming. Also the location of some valve seats requires the operator to perform the operation from a very awkward position. Invariably the operator endures extreme fatigue and boredom from the repetitious hand lapping steps.

SUMMARY OF THE INVENTION

The present invention provides a machine for in-situ grinding the top surface of an annular body, such as the face of a hull valve seat. This has been accomplished by providing a block which is receivable within the annular body, the top of the block having a central hole. A plurality of rods slidably extend transversely through the block with a first end of each rod extendable into the hole and a second end of each rod extendable from a side of the block opposite the inside curved surface of the annular body. A plurality of arcuate pads are provided wherein each pad has an arc which conforms to the curve of the inside surface of the annular body. Each rod is connected to a respective second end of each rod. A bolt is threaded into the central hole of the block, the bolt having a bottom tapered portion for engaging the first ends of the rods so that when the bolt is threaded into the block the rods will be forced outwardly to engage the arcuate pads with the inside curved surface of the annular body. A turntable is slidably mounted on top of the block. A grinder is mounted on the turntable and has a downwardly facing grinding surface for engaging the top surface of the body. A device is provided for moving the grinding surface toward and away from the top surface of the body. With this arrangement the top surface of the annular body can be easily ground by merely operating the machine while mounted in the annular body.

OBJECTS OF THE INVENTION

An object of the present invention is to provide a machine for grinding the top surface of an annular body.

Another object is to provide a machine for in-situ grinding a top annular face of a valve seat.

A further object is to provide an inexpensive machine which can be easily and accurately mounted in the bore of a valve for efficiently grinding a top annular valve seat.

These and other objects of the invention will become more readily apparent from the ensuing specification when taken together with the drawings.

DESCRIPTION OF THE PREFERRED EMBODIMENT

Figure 2:
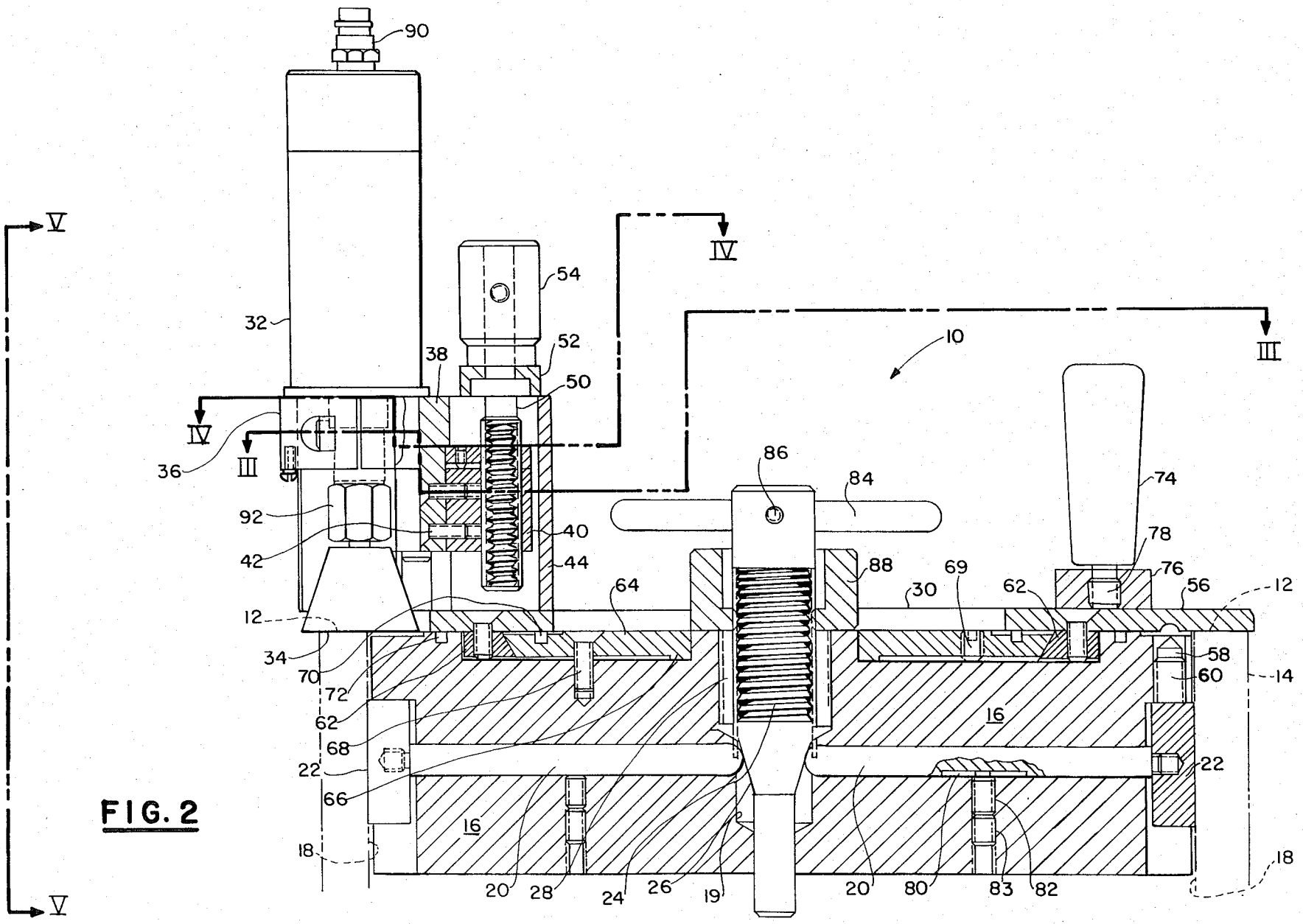
FIG. 2 is a transverse section through the grinder with the valve body shown in phantom.

Referring now to the drawings wherein like reference numerals designate like or similar parts throughout the several views, there is illustrated in FIG. 2 a machine 10 for grinding a top seat 12 of a valve 14, the valve 14 being illustrated in phantom. The machine 10 includes a block 16 which is receivable within the annular opening 18 of the valve body 14. The top of the block 16 is provided with a central hole 19 which may extend completely through the block if desired. A plurality of rods 20 slidably extend transversely through the block 16 with a first end of each rod extendable into the hole 19, and a second end of each rod 20 extendable from a side of the block opposite the inside annular surface 18 of the valve body 14. A plurality of arcuate pads 22 are provided wherein each pad has an arc which conforms to the inside curve 18 of the valve body. Each pad 22 is mounted to a respective second end of each rod 20. A bolt 24 is threaded into the central hole 19, the bolt having a bottom tapered portion 26 for engaging the first ends of the rods 20. When the bolt 24 is threaded into the block 16 the rods 20 will be forced outwardly by the tapered portion 26 to tightly engage the arcuate pads 22 with the inside annular surface 18 of the valve body. Four such rods 20 and pads 22 may be utilized, each being spaced 90° from each other. It is desirable that the block 16 be made of a light material, such as aluminum, to ease the mounting of the machine within the valve body 14. With such a material it is desirable to utilize a threaded insert 28 of a hard material, such as steel, to threadingly engage both the block and the bolt 24.

Figure 1:
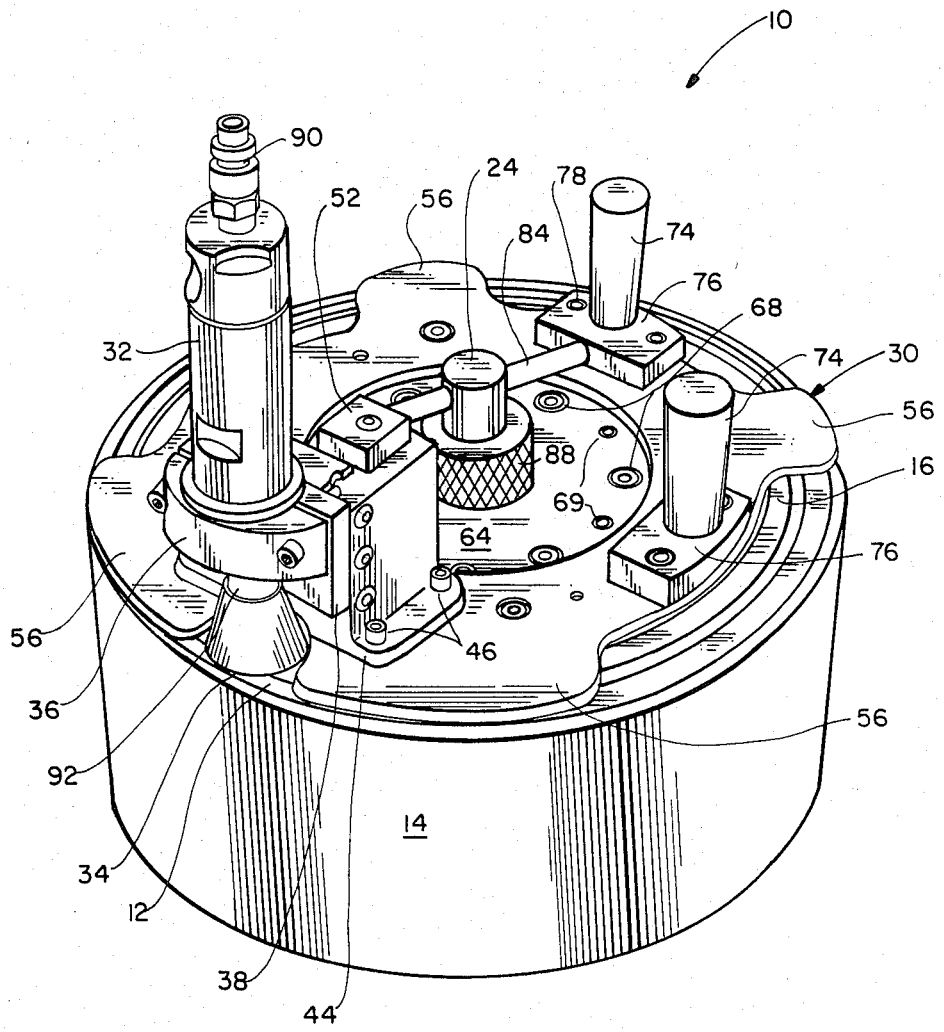
FIG. 1 is a perspective view of the grinder mounted in the bore of a valve for grinding a top annular valve seat.
Figure 3:
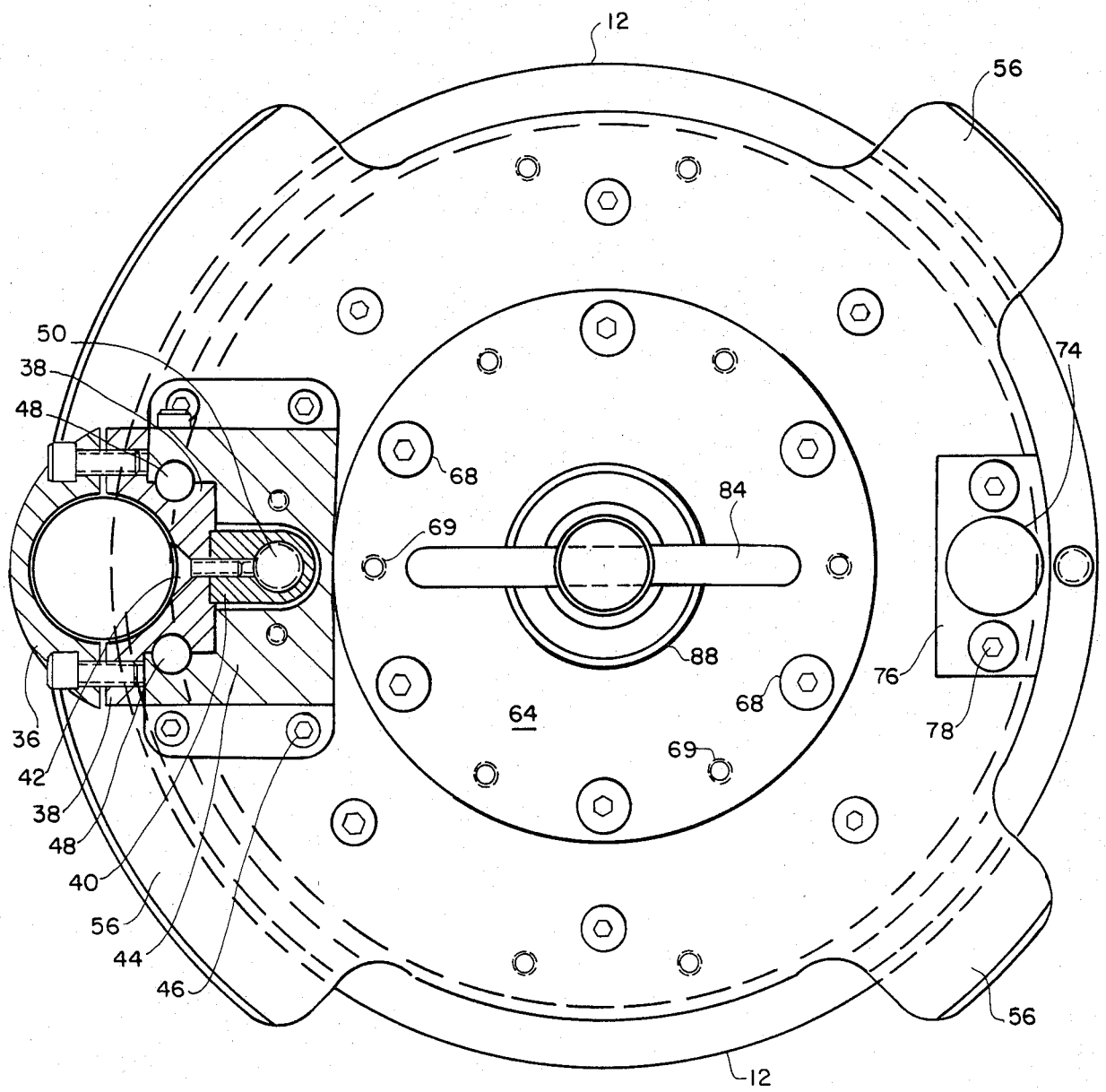
FIG. 3 is a cross-section taken along plane III—III of FIG. 2.
Figure 4:
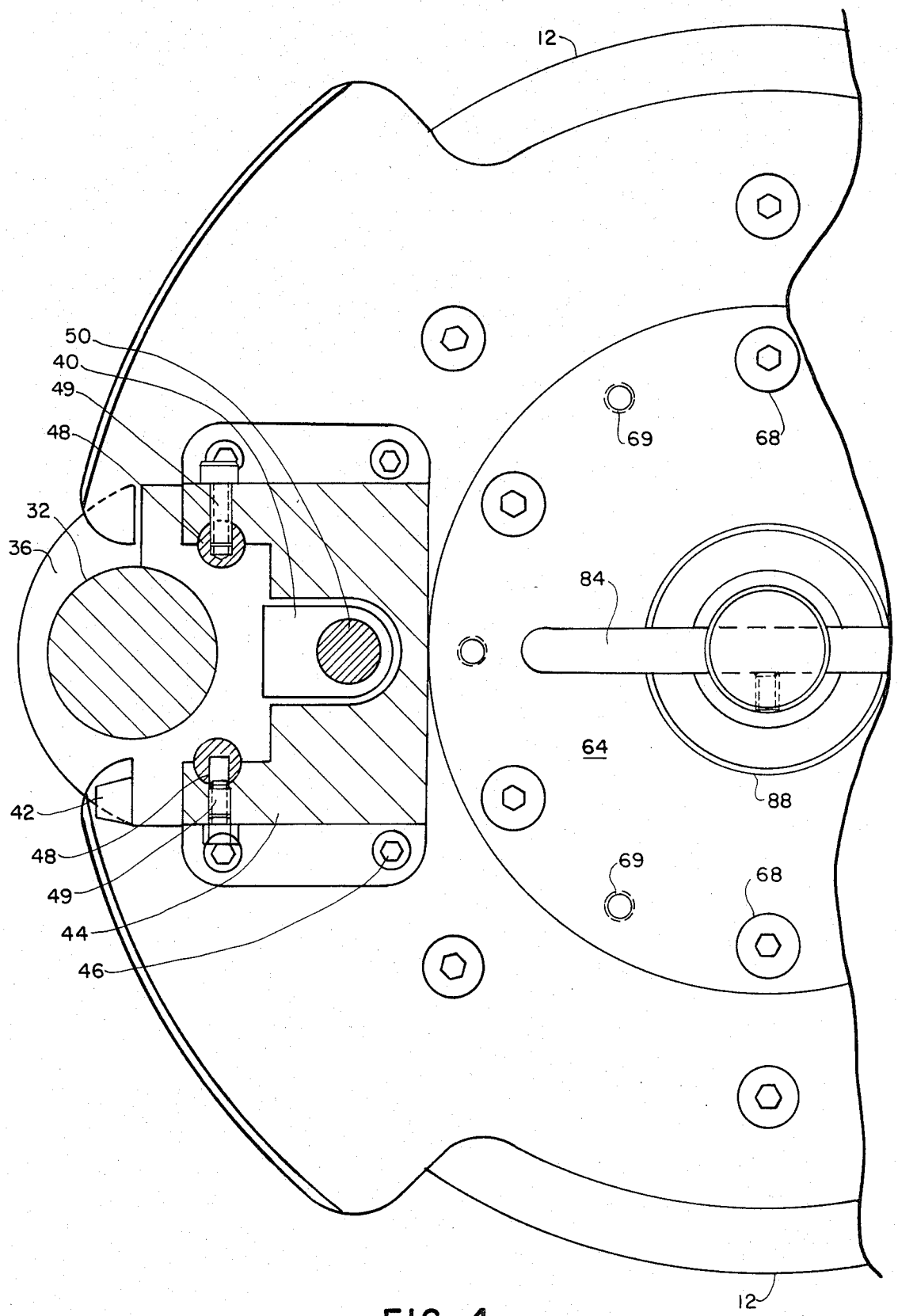
FIG. 4 is a cross-section taken along plane IV—IV of FIG. 2.
Figure 5:
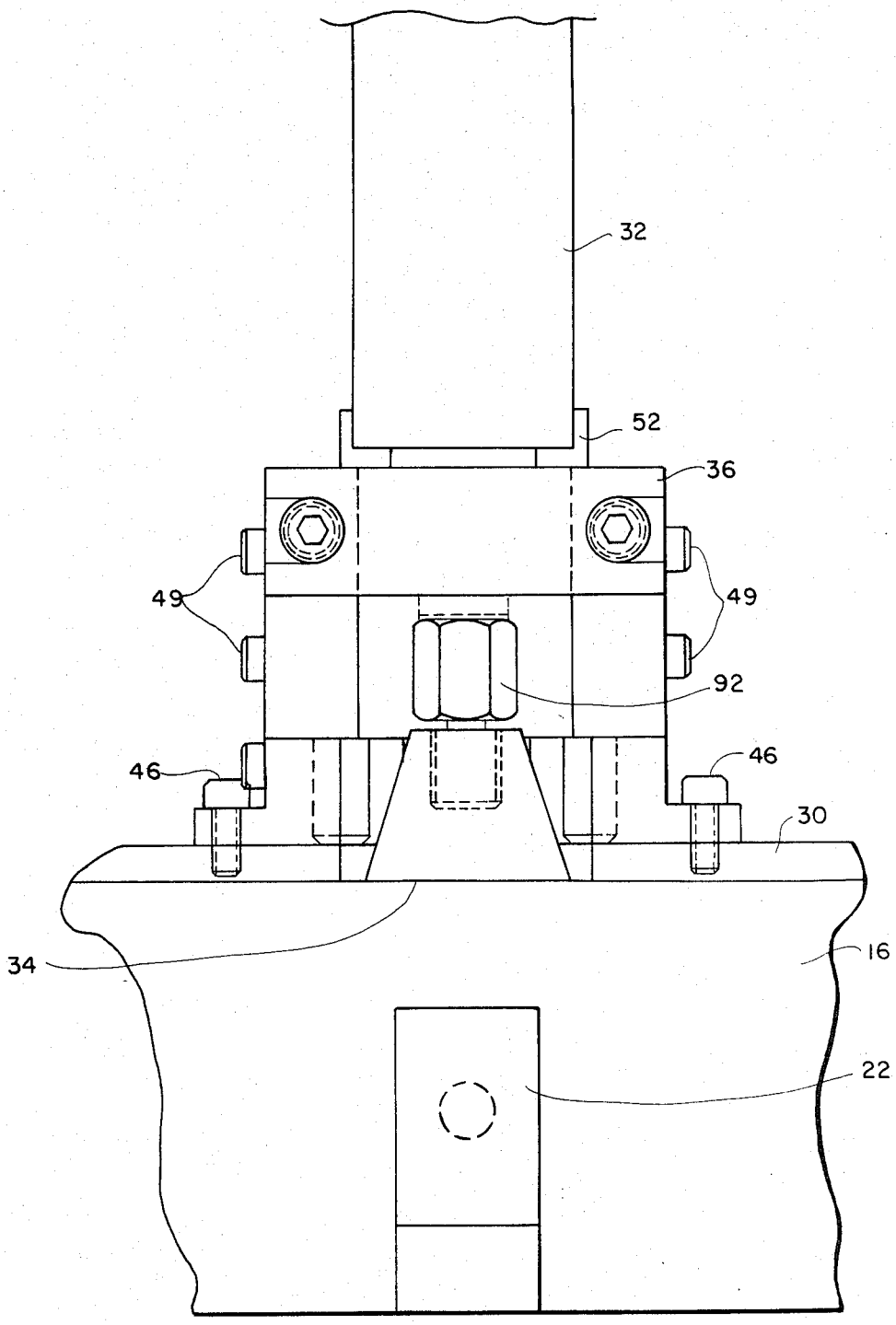
FIG. 5 is a front view of the grinder taken along plane V—V of FIG. 2.

As illustrated in FIGS. 1, 2 and 3, the machine 10 also includes a turntable 30 and means for slidably mounting the turntable 30 on the block 16, the mounting means being described in detail hereinafter. A grinding device 32 which has a downwardly facing grinding surface 34 is mounted on the turntable 30 for engaging the top surface 12 of the valve body 14. The grinding device 32 may be held by a clamp 36 which is bolted to a plate 38. Means are provided for moving the grinding surface 34 toward and away from the annular seat 12 of the valve body. This means may include a threaded element 40 which is bolted to the plate 38 by bolts 42. The threaded element 40 and the plate 38 are slidably mounted in a stand 44 which is mounted to the turntable 30 by bolts 46 (See FIGS. 3 and 4). Slidable movement between these members is accurately maintained by a pair of gibs 48 which are mounted between the stand 44 and the plate 38 by setscrews 49 (see FIGS. 4 and 5). As shown in FIG. 2, a bolt 50 is threaded through the element 40 and is positionally maintained by a thrust plate 52 so that when the bolt is turned by a knob 54 the element 40 will cause the grinding surface 34 to move upwardly or downwardly depending upon which way the bolt 50 is rotated.

An important feature of the present invention is the ease with which it can be accurately mounted within the bore of the valve body 14. As stated hereinabove the pads 22 are thrusted radially outwardly by the bolt 24 to tightly engage the interior annular surface 18 of the valve body. Accurate positioning prior to such engagement may be accomplished by providing the turntable 30 with radial extensions 56, as illustrated in FIG. 1. These radial extensions engage the top surface 12 of the valve body so that the block 16 can be accurately centered before the pads 22 are brought into engagement with the inside annular surface 18. As shown on the right side of FIG. 2 a diamond tool dresser 58, which is shown out of position for illustration purposes, may be slidably mounted for up and down movements within a top edge portion of the block 16 for dressing the bottom grinding surface 34. The diamond dresser 58 may be selectively positioned by a set screw 60 which is connected thereto.

Another feature of the invention is the means for rotatably mounting the turntable 30 on the block 16. This mounting means may include an annular bearing 62 which is slidably mounted in the top of the block 16, the inside edge of the bearing being downwardly leveled. An annular plate 64 is mounted in the top of the block adjacent to and inwardly of the annular bearing 62, the outward edge of the annular plate 64 being upwardly beveled so as to mate with the inside edge of the bearing 62. Means, such as a downwardly extending annular flange 66, is provided adjacent the inner edge of the annular plate 64 for spacing the bottom of the annular plate 64 from the top of the block 16. Means, such as a bolt 68 and a setscrew 69, are threaded through the annular plate 64 between the spacing means 66 and the outward edge of the plate for selectively changing the spacing of the bottom of the annular plate 64 from the top of the block 16. It should be noted that with this arrangement adjustment of the bolt 68 and the setscrew 69 will selectively establish the bearing pressure between the beveled edges of the plate 64 and the bearing 62. As illustrated in FIG. 2, the turntable 30 extends inwardly and outwardly from the annular bearing 62 so as to override the tops of the annular plate 64 and block 16 respectively. Annular wipers 70 and 72 are provided with the wiper 70 being mounted in the top of the annular plate 64 and the wiper 72 being mounted in the top of the block 16 so as to slidably engage respective bottom portions of the inward and outward turntable extensions. With this arrangement the bearing 62 is maintained dirt free. The turntable 30 and the unique mounting arrangement of this turntable on the block 16 enables the turntable 30 to be easily rotated with the grinding face 34 in engagement with the top annular seat 12 to be refurbished. Upstanding handles 74 are fixed to the top of the turntable 30 by any suitable means such as a block 76 and bolts 78. The operator can then easily utilize these handles to rotate the grinding surface 34 around the valve seat 12.

Before mounting the block 16 in the valve body 14 it is important that the rods 20 not drop out of the block. This can easily happen when the operator is attempting to install the grinding machine 10 in an awkward location. Retention of the rods 20 can be maintained by providing each rod 20 with a notch 80 along its length. A respective setscrew 82 is threaded into the bottom of the block 16 and extends into this notch so as to limit the transverse movements of the rods. Another setscrew 83 may be utilized to retain the setscrew 82 in place. In order to facilitate operation of the bolt 24 a handle 84 may be transversely mounted through the bolt and held in position by a set screw 86. The positioning of the bolt 24 may be fixed by a locknut 88 which bears against the top of the block 16. The grinding device 32 may simply be an airmotor which has a top air hose fitting 90 with the grinding element 34 being connected at its bottom end by a nut 92.

OPERATION OF THE INVENTION

In the operation of the invention the grinding machine 10 is taken to the site of a valve body 14 which is to have its top valve seat surface 12 refurbished. The bolt 24 is withdrawn from the block 16 sufficiently so that the tapered portion 26 thereof allows the pads 22 to be positioned inwardly of that shown in FIG. 2. The block 16 is then inserted into the valve body 14 with the turntable extensions 56 resting directly on top of the valve seat 12, as illustrated in the right portion of FIG. 2. The turntable extensions 56 enable the grinding machine 10 to be accurately positioned in a central location within the valve body 14. The handle 84 is then turned so that the tapered portion 26 of the bolt forces the pads 22 tightly against the interior annular surface 18 of the valve body. The machine is now in position for commencing the grinding operation. The knob 54 is adjusted so that the grinding face 34 is slightly above the valve face 12 which is to be refurbished. A hose (not shown) is connected to the fitting 90 and air is supplied to operate the airmotor 32 which will in turn rotate the grinding face 34. The knob 54 is then turned to bring the grinding surface 34 into engagement with the valve face 12. By utilizing the handles 74 the turntable 30 is rotated so that the grinding surface 34 is rotated about the valve face 12. After one or more rotations the knob 54 is turned a slight amount to keep the grinding surface 34 in grinding engagement with the valve face 12 until the face is completely refurbished with a smooth planar face throughout its entire circumference. When the grinding surface 34 needs to be dressed the diamond dresser 58 is extended upwardly by the setscrews 60 to engage the grinding face 34. When properly dressed the diamond dresser 58 is withdrawn by the setscrew 60. When the operation is completed the steps are simply reversed by disconnecting the air hose (not shown) and rotating the handle 84 to release the pads 22 from the valve body 14. The machine can then be withdrawn from the valve body and stored for reuse.

Obviously, many modifications and variations of the present invention are possible in the light of the above teachings. It is therefore to be understood that within the scope of the appended claims the invention may be practiced otherwise than as specifically described.

What is claimed is:

1. A machine for grinding the top surface of an annular body comprising:

a block which is receivable within the annulus of the body;

the top of said block having a central hole;

a plurality of rods slidably extending transversely through the block with a first end of each rod extendable into said hole and a second end of each rod extendable from a side of the block opposite the inside surface of the annulus of said body;

a plurality of arcuate pads, each pad having an arc which conforms to the inside curve of the body annulus and being mounted to a respective second end of each rod;

a bolt threaded into the central hole of the block, said bolt having a bottom tapered portion for engaging the first ends of the rods so that when the bolt is threaded into the block the rods will be forced outwardly to engage the arcuate pads with the inside annular surface of the body;

a turntable;

means slidably mounting the turntable on top of the block;

the turntable having radial extensions for engaging the top surface of the annular body so that the block can be accurately centered before the pads are brought into engagement with the inside annular surface of the body;

grinding means mounted on the turntable and having a downwardly facing grinding surface for engaging the top surface of the body; and means for moving the grinding surface toward and away from the top surface of the body.

2. A grinding machine as claimed in claim 1 including:

a tool dresser adjustably mounted in the block in the path of the grinding surface for truing up said grinding surface.

3. A machine for grinding the top surface of an annular body comprising:

a block which is receivable within the annulus of the body;

the top of said block having a central hole;

a plurality of rods slidably extending transversely through the block with a first end of each rod extendable into said hole and a second end of each rod extendable from a side of the block opposite the inside surface of the annulus of said body;

a plurality of arcuate pads, each pad having an arc which conforms to the inside curve of the body annulus and being mounted to a respective second end of each rod;

a bolt threaded into the central hole of the block, said bolt having a bottom tapered portion for engaging the first ends of the rods so that when the bolt is threaded into the block the rods will be forced outwardly to engage the arcuate pads with the inside annular surface of the body;

a turntable;

means slidably mounting the turntable on top of the block, said means including:

an annular bearing fixedly mounted to the bottom of the turntable;

said annular bearing being slidably mounted in the top of the block, the inside edge of the bearing being downwardly beveled;

an annular plate mounted in the top of the block adjacent to and inwardly of the annular bearing, the outward edge of the annular plate being upwardly beveled so as to mate with the inside edge of the bearing;

means adjacent the inner edge of the annular plate for spacing the bottom of the annular plate from the top of the block; and means threaded through the annular plate between the spacing means and the outward edge for selectively changing the spacing of the bottom of the annular plate from the top of the block;

grinding means mounted on the turntable and having a downwardly facing grinding surface for engaging the top surface of the body; and means for moving the grinding surface toward and away from the top surface of the body.

4. A grinding machine as claimed in claim 3 including:

the turntable extending inwardly and outwardly from the annular bearing to override the tops of the annular plate and block respectively; and an annular wiper mounted in each respective top of the annular plate and the block for slidably engaging a respective bottom of the inward and outward turntable extensions, whereby the bearing is maintained dirt free.

5. A grinding machine as claimed in claim 4 including:

a handle mounted to the top of the turntable and extending upwardly therefrom.

6. A grinding machine as claimed in claim 5 including:

each of said rods having a notch along its length;

means threaded through the bottom of the block and extending into the notches for limiting transverse movements of the rods.

7. A machine for grinding the top surface of an annular body comprising:

a block which is receivable within the annulus of the body;

means for centering and fixedly retaining the block within the annulus of the body;

a turntable;

an annular bearing fixedly mounted to the bottom of the turntable;

said annular bearing being slidably mounted in the top of the block, the inside edge of the bearing being downwardly beveled;

an annular plate mounted in the top of the block adjacent to and inwardly of the annular bearing, the outward edge of the annular plate being upwardly beveled so as to mate with the inside edge of the bearing;

means adjacent the inner edge of the annular plate for spacing the bottom of the annular plate from the top of the block; and means threaded through the annular plate between the spacing means and the outward edge for selectively changing the spacing of the bottom of the annular plate from the top of the block;

grinding means mounted on the turntable and having a downwardly facing grinding surface for engaging the top surface of the body; and means for moving the grinding surface toward and away from the top surface of the body.

8. A grinding machine as claimed in claim 7 including:

the turntable extending inwardly and outwardly from the annular bearing to override the tops of the annular plate and block respectively; and an annular wiper mounted in each respective top of the annular plate and the block for slidably engaging a respective bottom of the inward and outward turntable extensions, whereby the bearing is maintained dirt free.

9. A grinding machine as claimed in claim 8 including:

a tool dresser adjustably mounted in the block in the path of the grinding surface for truing up said grinding surface.

* * * * *